US008814064B2

(12) United States Patent
Oag

(10) Patent No.: US 8,814,064 B2
(45) Date of Patent: Aug. 26, 2014

(54) NOZZLE

(75) Inventor: Jamie Oag, Aberdeen (GB)

(73) Assignee: Optima Solutions UK Limited, Aberdeen (GB)

( * ) Notice: Subject to any disclaimer, the term of this patent is extended or adjusted under 35 U.S.C. 154(b) by 1128 days.

(21) Appl. No.: 10/598,447

(22) PCT Filed: Feb. 28, 2005

(86) PCT No.: PCT/GB2005/000758

§ 371 (c)(1),
(2), (4) Date: Sep. 20, 2006

(87) PCT Pub. No.: WO2005/084815

PCT Pub. Date: Sep. 15, 2005

(65) Prior Publication Data

US 2008/0237387 A1 Oct. 2, 2008

(30) Foreign Application Priority Data

Mar. 5, 2004 (GB) ..... 0405088.6

(51) Int. Cl.

| | |
|---|---|
| ***B05B 1/34*** | (2006.01) |
| ***B05B 1/26*** | (2006.01) |
| ***A62C 35/00*** | (2006.01) |
| ***A62C 37/08*** | (2006.01) |
| ***B65H 37/00*** | (2006.01) |

(52) U.S. Cl.

CPC ..... *B65H 37/005* (2013.01); *B65H 2701/194* (2013.01); *B65H 2701/19402* (2013.01)

USPC ..... 239/480; 239/505; 239/514; 239/518; 169/16

(58) Field of Classification Search

USPC ..... 239/518, 520, 521, 523, 524, 464, 479, 239/480, 481, 505, 506, 507, 514; 169/37, 169/16

See application file for complete search history.

(56) References Cited

U.S. PATENT DOCUMENTS 89,456 A * 4/1869 Allen ..... 239/391
163,101 A * 5/1875 Orr ..... 239/533.15

(Continued)

FOREIGN PATENT DOCUMENTS

AU 2008101130 1/2009
AU 2008101133 1/2009

(Continued)

OTHER PUBLICATIONS

Revocation Proceedings in the matter UK Patent No. 2425742B between Rigcool Limited and Optima Solutions Limited (2007-2008).

(Continued)

*Primary Examiner* — Justin Jonaitis

(74) *Attorney, Agent, or Firm* — Daniel N. Lundeen; Lundeen & Lundeen PLLC

(57) ABSTRACT

A nozzle for use with a pressurized water source as typically used in the offshore environment. The nozzle attaches to a hose or fixed work pipe installation and provides a channel through a body, on which is arranged a frusto-conical fluid deflector. Fluid flowing along the channel may impinge upon the fluid deflector and may travel along a surface of the deflector and out of the nozzle in a jet. Various embodiments are described for varying the width of the channel at the deflector to adjusting, a characteristic of the jet and for providing self-cleaning of the nozzle. Further a central channel is described which allows an additional nozzle to be included as are sensors which determine pressure, temperature and the like in the nozzle.

27 Claims, 8 Drawing Sheets

(56) References Cited

U.S. PATENT DOCUMENTS

| | | | | |
|---|---|---|---|---|
| 1,628,823 | A * | 5/1927 | Chester et al. | 239/453 |
| 2,207,758 | A | 7/1940 | Rehse | |
| 2,323,464 | A * | 7/1943 | Glessner | 239/441 |
| 3,045,926 | A | 7/1959 | Steinen | |
| 3,012,733 | A | 12/1960 | Allenbaugh, Jr. | |
| 3,029,030 | A * | 4/1962 | Dey, Sr. | 239/520 |
| 3,045,931 | A | 7/1962 | Hall | |
| 3,101,176 | A * | 8/1963 | Goss | 239/524 |
| 3,387,791 | A * | 6/1968 | Allenbaugh, Jr. | 239/458 |
| 3,940,069 | A * | 2/1976 | Gunzel et al. | 239/318 |
| RE29,717 | E | 8/1978 | Thompson | |
| 4,437,611 | A | 3/1984 | Gilroy | |
| 5,954,877 | A * | 9/1999 | Hayes | 118/319 |
| 6,183,941 | B1 * | 2/2001 | Hayes | 430/329 |
| 6,652,624 | B2 | 11/2003 | Ku et al. | |
| 2002/0020764 | A1 * | 2/2002 | Bendig et al. | 239/506 |
| 2003/0146301 | A1 * | 8/2003 | Sun et al. | 239/399 |
| 2004/0028476 | A1 * | 2/2004 | Payne et al. | 405/184 |

FOREIGN PATENT DOCUMENTS

| | | |
|---|---|---|
| CA | 549795 | 12/1957 |
| EP | 0339363 | 11/1989 |
| EP | 0363162 | 11/1990 |
| EP | 0659461 | 6/1995 |
| EP | 0724913 | 7/1996 |
| EP | 0979681 | 12/2004 |
| GB | 0545653 | 3/1946 |
| GB | 1379205 | 1/1975 |
| GB | 2299281 | 2/1996 |
| GB | 2425742 | 6/2007 |

OTHER PUBLICATIONS

Elkhardt Brass Mfg. Co., Inc., 8494 Sidewinder (TM) RF Monitor, Installation Operating & Maintenance Instructions (2006).

Todd Lozier, Witness statement, from Revocation Proceedings in the matter of UK Patent No. 2425742B between Rigcool Limited and Optima Solutions Limited (Jan. 21, 2008).

Jamie Thompson, Witness statement, from Revocation Proceedings in the matter of UK Patent No. 2425742B between Rigcool Limited and Optima Solutions Limited (Dec. 24, 2007).

Closed Record of Proceedings, Intellectual Property Cause (including alleged infringement of UK Patent No. 2425742B), Optima Solutions UK Limited against Ian Garden & Another, Court of Session, Edinburgh UK (Aug. 2010).

Minute of Amendment on Behalf of Defenders to Record of Proceedings, Intellectual Property Cause (including alleged infringement of UK Patent No. 2425742B), Optima Solutions UK Limited against Ian Garden & Another, Court of Session, Edinburgh UK (as adjusted Oct. 12, 2010, and as further adjusted Nov. 8 and 10, 2010).

Second Inventory of Prodictions for the Defenders, Intellectual Property Cause (including alleged infringement of UK Patent No. 2425742B), Optima Solutions UK Limited against Ian Garden & Another, Court of Session, Edinburgh UK (2010) [includes D42 and D05 nozzles, and TYCO D3 Protectospray].

Third Inventory of Prodictions for the Defenders, Intellectual Property Cause (including alleged infringement of UK Patent No. 2425742B), Optima Solutions UK Limited against Ian Garden & Another, Court of Session, Edinburgh UK (2010) [includes photos of D05 nozzles].

* cited by examiner

NOZZLE

The present invention relates to a nozzle. In particular, but not exclusively, the present invention relates to a nozzle for use with a pressurised water source as typically used in the offshore environment.

During well completion, a surface well test package is used to evaluate well reservoir parameters and hydrocarbon properties. The evaluation of hydrocarbon properties requires the flow of a hydrocarbon fluid to the well test package from the well. Once the test has been made it is necessary to dispose of the hydrocarbon fluid. This is done by igniting the hydrocarbon fluid and flaring it from drilling rig, Floating Production Storage and Offloading vessels (FPSOs), Drillships, platforms and land rig burner booms. The flaring operation can cause temperatures to reach levels where the intense heat can compromise the integrity of the structure and rig safety equipment such as lifeboats, lifecrafts etc and create a hazardous working environment for personnel. One way of reducing the temperature around the flaring hydrocarbons is to form a water wall around the flare, known as a rig cooling system and/or heat suppression and/or deluge system.

Systems of this type provide an outer wall of water designed to surround the flare which mimics the flare profile and/or shields the flare. The outer wall of water can take the form of a solid flat or conical shield or curtain and a central source which has a secondary function of generating a very fine mist of water through the central outlet of the dual nozzle design. The fine mist of water is designed to remove energy from the flare, and the outer wall of water is designed to create a barrier which also removes energy and therefore temperature from the flare.

In order to produce and shape a jet of water, it is necessary to connect a nozzle to a high-pressure water source and to engineer the nozzle such that an outer (typically cone-shaped) wall of water is formed in conjunction with a fine mist of water directed behind the flare.

An example of this type of nozzle is provided in UK Patent No. GB2299281. This document discloses a nozzle attachable to a high-pressure water source in which a narrow opening is positioned between a deflecting surface which opposes the direction of flow of water, and a guiding surface angled towards the direction of flow of the water and which defines the shape of the outer wall of water that is produced by this nozzle. It has been found that the combined action of the deflecting surface and guiding surface disrupts the water flow and causes energy to be dissipated thus lowering the water pressure. It is an object of the present invention to provide an improved nozzle.

In accordance with a first aspect of the present invention, there is provided a nozzle for a hose or fixed pipework installation, the nozzle comprising:

a body;

a channel extending through the body of the nozzle; and a fluid deflector arranged at or near the downstream end of the channel, and wherein the fluid deflector determines the direction of flow of the fluid as it leaves the nozzle.

Fluid flowing along the channel may impinge upon the fluid deflector and may travel along a surface of the deflector and out of the nozzle, the direction of flow of the fluid as it leaves the nozzle thereby determined by the deflector. By this arrangement, the fluid deflector may serve to direct the fluid whilst minimising energy loss when compared to prior nozzles of the type where the fluid is thrown backwards onto a second directing surface which directs the fluid out of the nozzle.

The fluid deflector may be located in a fluid flow path extending through the nozzle along the channel.

Preferably, the fluid deflector and the body of the nozzle together define a width of the channel at or near said downstream end. The fluid deflector may have a deflecting surface positioned relative to the end of the channel to define the width of the channel at or near the downstream end of the channel. Accordingly, at least part of the channel may be defined between the deflecting surface and an outlet surface of the body. The deflecting surface and the body outlet surface may be substantially parallel.

The deflector surface may be disposed at an obtuse angle relative to a main axis of the body and is preferably angled away from the body.

More preferably, said channel width is variable. This may facilitate adjustment of a characteristic and/or parameter of the fluid exiting the nozzle, including velocity, fluid pressure, and/or the shape of a jet, stream or cloud of fluid exiting the nozzle. The channel width may be variable by adjusting a position of the fluid deflector relative to a remainder of the nozzle, in particular, relative to the nozzle body.

The fluid deflector may be movably mounted relative to the body, to enable adjustment of a position of the deflector relative to the body. This may facilitate adjustment of the channel width.

Preferably, the channel is provided with a gap or space suitable for accommodating a spacer to, alter the position of the fluid deflector relative to the end of the channel, thereby varying the width of said channel.

Alternatively, the deflector may be threadably coupled to the body, such that rotation of the deflector relative to the body may advance and/or retract the deflector relative to the body, thereby facilitating adjustment of the channel width. The nozzle may include a retaining member, such as a nut, clip or the like, for retaining the deflector in a desired position relative to the body, to fix the channel width.

The nozzle may comprise a mechanism for adjusting the channel width, which may be a self-cleaning mechanism. The mechanism may be hydraulic, electrical, electro-mechanical or mechanical, and may comprise an actuator for controlling a position of the deflector relative to the body, for adjustment of the channel width. The actuator may, be adapted to be activated to move the deflector to increase the channel width, in order to facilitate flow of any debris such as particulate matter trapped in the nozzle and impeding fluid flow. The mechanism may comprise one or more sensors for detecting the presence of trapped debris. For example, the nozzle may include a pressure sensor or flowmeter for detecting an increase in pressure or reduction in fluid flow rate through the channel indicative of the presence of trapped debris impeding fluid flow.

Preferably, the fluid deflector comprises the deflecting surface and a central beam, shaft, boss or the like extending from the deflecting surface into the body of the nozzle, the central beam being attachable to the body of the nozzle.

Preferably, the nozzle is further provided with pressure sensing means.

Preferably, the channel extending through the body of the nozzle is an annular channel, but may be of any alternative, suitable shape.

Preferably, the nozzle further comprises a central channel extending through the body of the nozzle.

Preferably, the central channel extends through the central beam of the deflector.

The pressure sensing means may be located in the fluid deflector.

Optionally, the pressure sensing means is located in the body of the nozzle.

Preferably, the fluid deflector means further comprises filter coupling means for coupling a filter to the upstream end of the central channel.

Preferably, the fluid deflector means further comprises nozzle-coupling means for coupling a nozzle to the downstream end of the central channel.

More preferably, said nozzle coupling means is connectable to a nozzle for producing a fine spray of fluid.

Preferably, the fluid deflector means is frusto-conical and is thus provided with a frusto-conical deflecting surface, angled away from the direction of fluid flow. Alternatively, the deflecting surface may be any other suitable shape and the deflector may be frusto-conical with an arcuate deflecting surface, in cross-section.

More preferably, the frusto-conical deflecting surface extends beyond the maximum width of the channel to direct the flow of fluid.

Preferably, the nozzle is generally cylindrical in shape.

Preferably, the nozzle is further provided with sensor means attached thereto.

More preferably, the sensor means are attached to the fluid deflector means.

More preferably, the sensor means are embedded in a front surface of the fluid deflector means.

The sensor means can be temperature sensors, gas sensors, or other suitable sensors and may be hardwired through the nozzle, to provide information on the temperature, gas composition pressure or other information.

The nozzle may be constructed in a single piece.

It will be understood that the nozzle may be suitable for use with a wide range of diameters of hoses or pipes of a pipework installation, and may therefore be dimensioned accordingly. However, embodiments of the invention may be particularly suited for use with hoses/pipes having diameters in the range of 1½" to 2" (approximately 38 mm to 51 mm), whilst other embodiments may be particularly suited for use with hoses/pipes having diameters of around 6" (approximately 152 mm) or more.

In accordance with a second aspect of the invention there is provided a kit of parts for a nozzle in accordance with the first aspect of the invention, the kit of parts comprising a body and a fluid deflector.

Preferably, the kit of parts further comprises a coupling means adapted to connect the deflector to the body.

Further features of the nozzle are defined in relation to the first aspect of the invention.

In accordance with a third aspect of the present invention, there is provided a nozzle comprising:

a body having a fluid outlet;

a fluid flow channel extending through the body, the channel in fluid communication with the body outlet; and a fluid deflector located adjacent the body outlet and positioned such that fluid flowing along the channel impinges on the deflector and is directed out of the nozzle by the deflector, the direction of flow of the fluid exiting the nozzle thereby determined by the deflector.

Further features of the nozzle are defined in relation to the first aspect of the invention.

The present invention will now be described by way of example only, with reference to the accompanying drawings, in which.

Figures 4A, 4B, 4C:
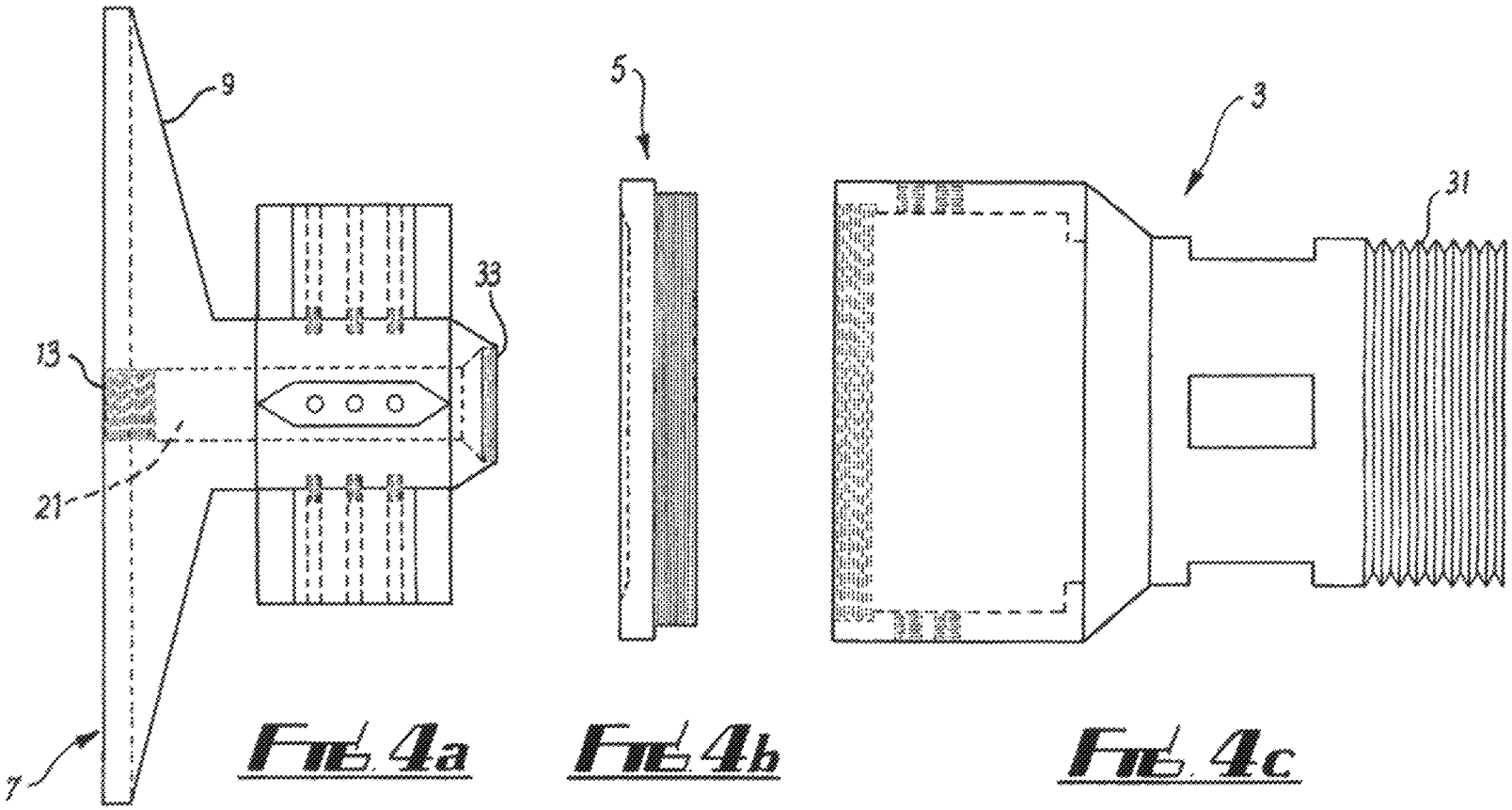
Figure 5:
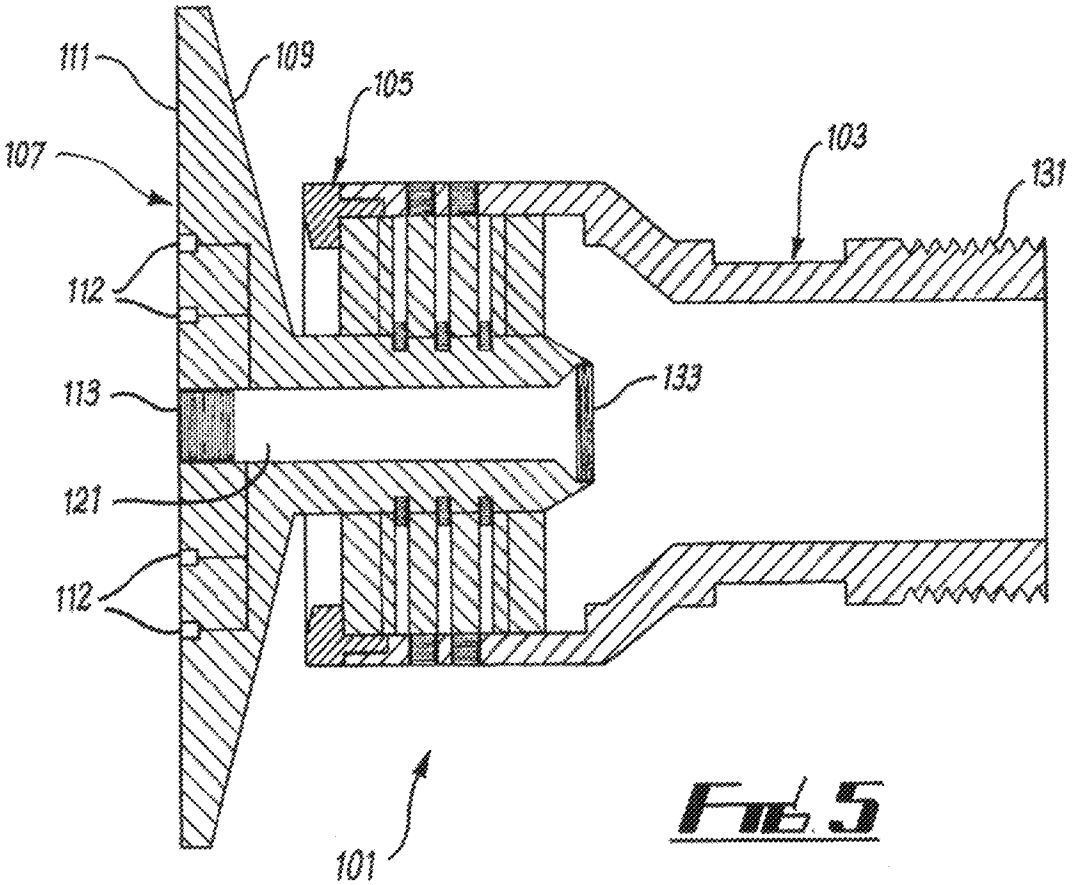
Figure 6:
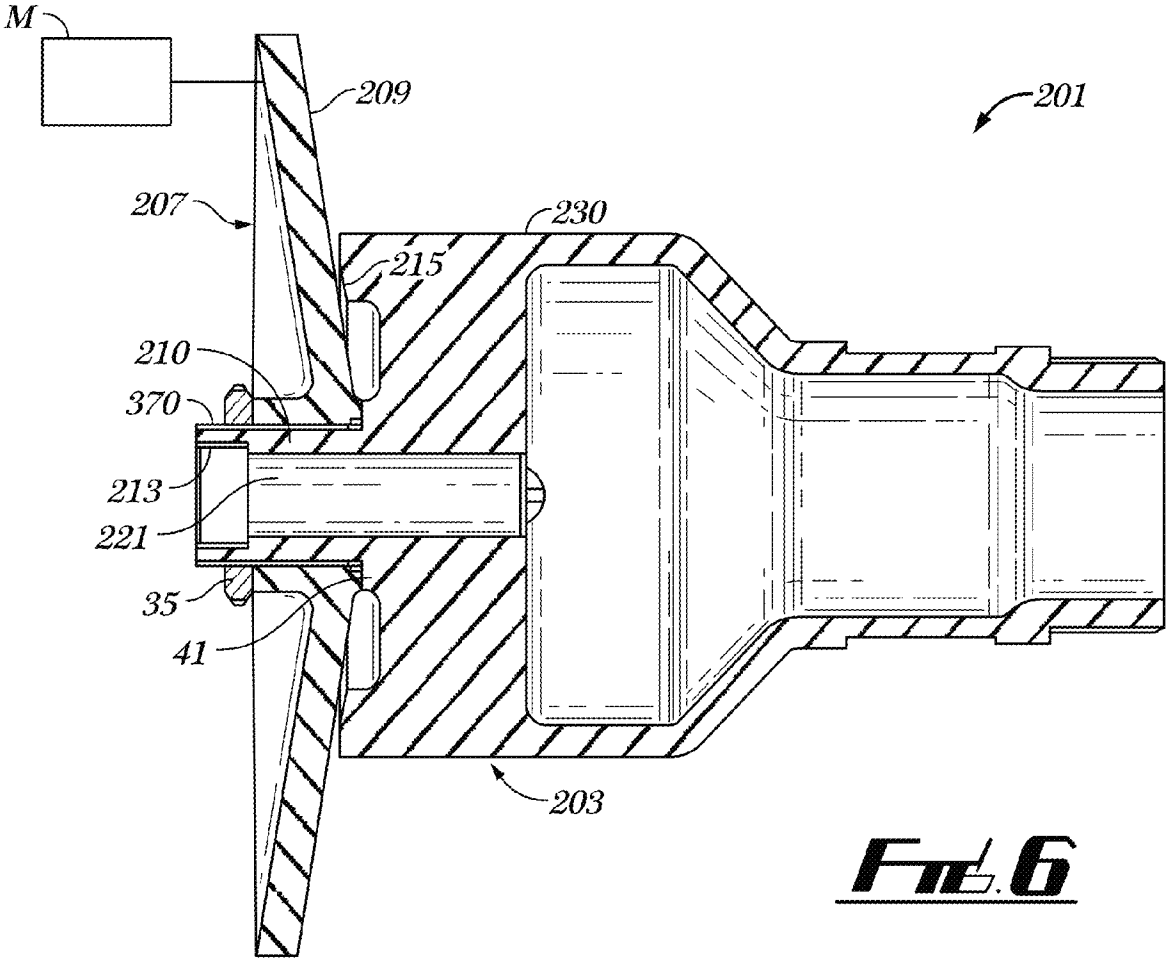
Figure 7:
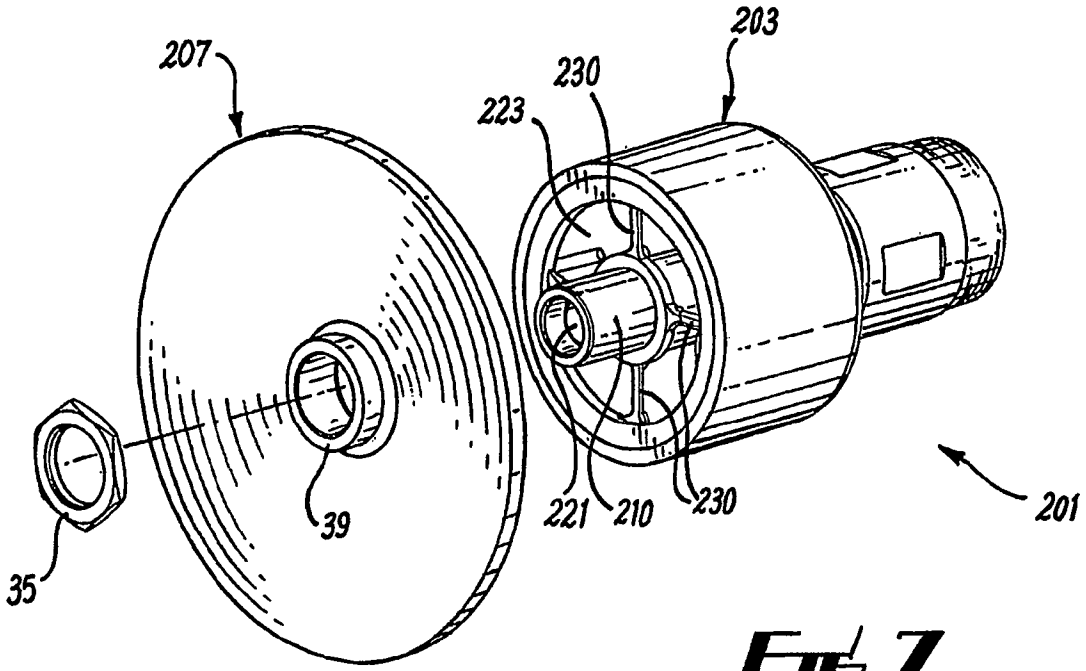
Figure 8:
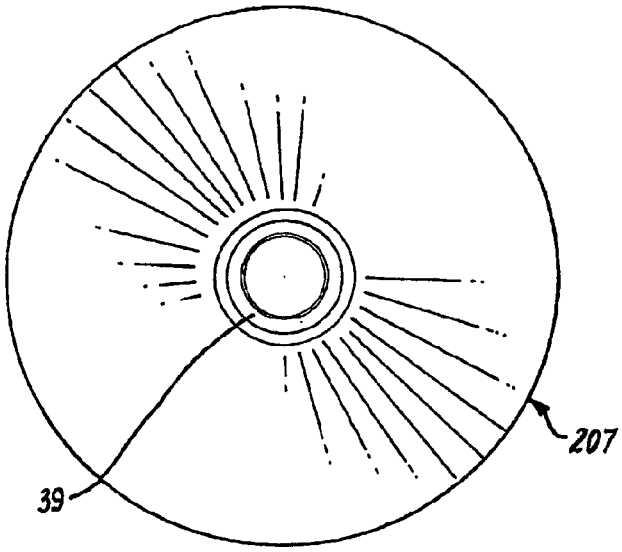
Figure 9:
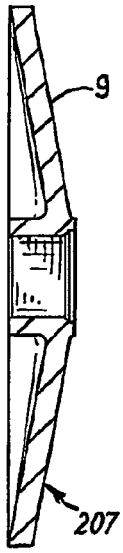
Figure 10:
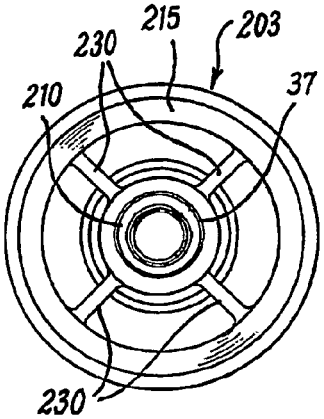
Figure 11:
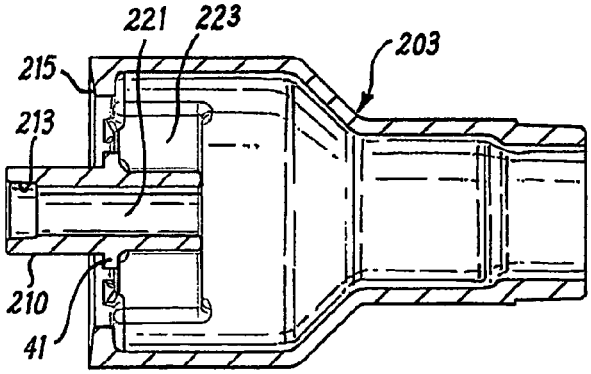

FIG. 4*a* shows the deflector of the present invention, FIG. 4*b* shows a coupling ring as used in the present invention and FIG. 4*c* shows a body of the nozzle of the present invention;

FIG. 5 shows a second embodiment of the present invention in which sensors are embedded into the front surface of the deflector means;

FIG. 6 is a longitudinal cross-sectional view of a nozzle in accordance with a third embodiment of the present invention;

FIG. 7 is an exploded perspective view of the nozzle of FIG. 6;

FIGS. 8 and 9 are end and sectional views, respectively, of a deflector forming part of the nozzle of FIG. 6; and FIGS. 10 and 11 are end and side, views, respectively, of a body forming part of the nozzle of FIG. 6.

Figure 1:
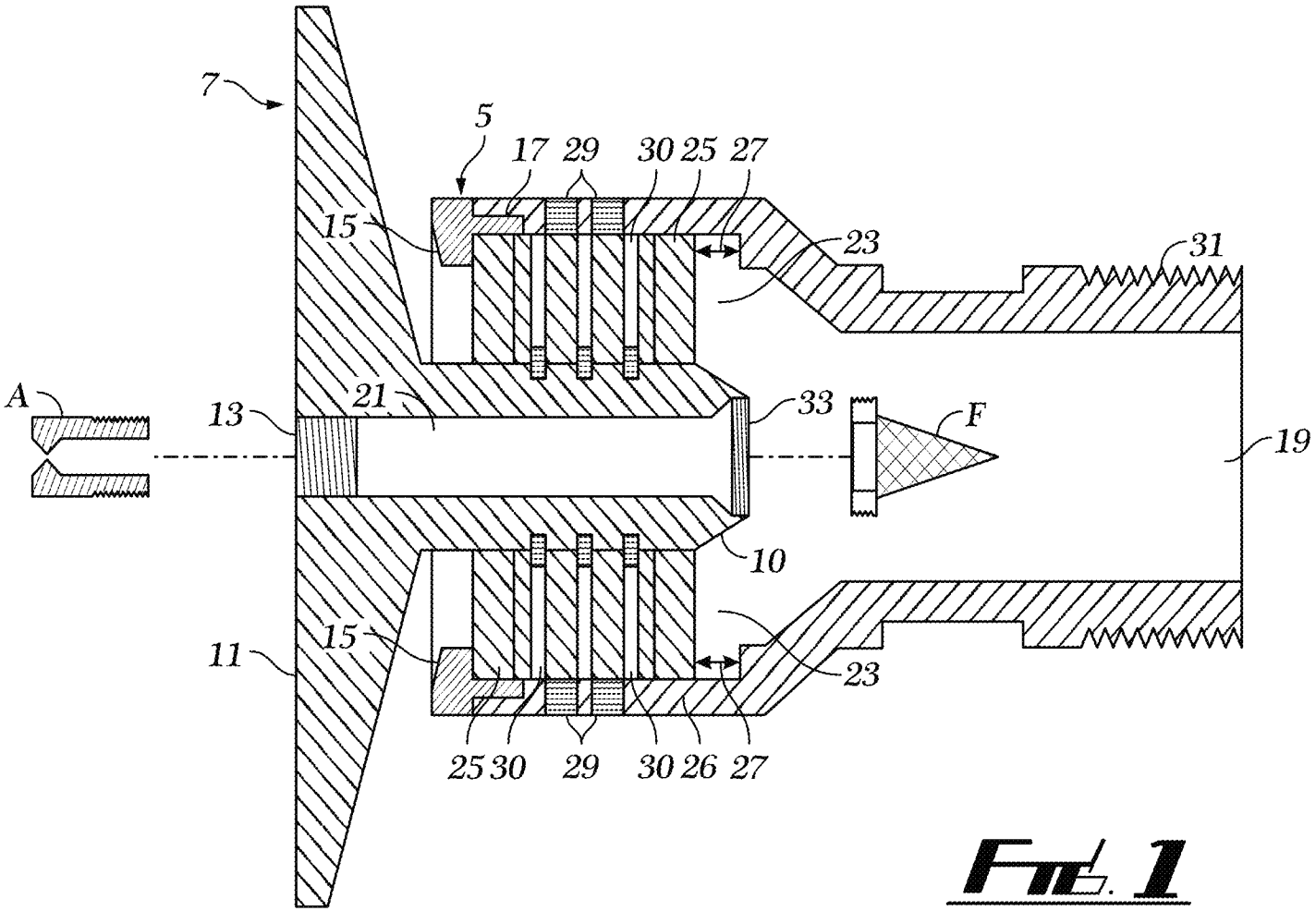
FIG. 1 is a longitudinal cross-sectional view of a nozzle in accordance with an embodiment of the present invention.

In the embodiment of the present invention shown in FIG. 1, the nozzle 1 is constructed from three separate components. These are the nozzle body 3, the coupling ring 5 and the deflector 7.

The deflector 7 is provided with a front surface 11, a deflecting surface 9 which is angled away from the direction of fluid flow and a central beam or projection 10 which extends into the nozzle body 3 and provides a central channel 21.

The central channel 21 has a filter coupler 33 to which a wire-mesh cone filter F known as a witches hat can be attached. The purpose of this filter F is to prevent particulates from entering the central channel 21. A second coupler 13 is attached to the downstream end of the central channel 21. The second coupler 13 is used to attach a further nozzle A for shaping the water flow. Suitably, the secondary nozzle A is designed to produce a fine spray or fog of water.

Typically, the water used will be filtered upstream of the nozzle. Therefore, the size of particulates entering the nozzle will have a maximum determined by the upstream filter.

The gap between the central beam 10 and the nozzle' body 3 defines an outer channel which, is annular in shape. Support means in the form of fins 30 extend between the central beam 10 and the nozzle body 3 to secure the deflector 7 in place. Grub screws 29 are used to further secure the deflector 9 in position. The nozzle may also be provided with a pressure indicator switch (not shown) located in the deflector surface or on the body of the nozzle. Fixed rings 25 are also included to position the deflector within the nozzle body 3.

The box section 26 provides abutting surfaces at either end thereof, and further provides an adjustable gap 27 which can be reduced in size by the inclusion of further spacer rings 40. Typically, an additional spacer ring 40 would be introduced at the downstream end of the box section 26 thereby moving the deflector in an upstream direction and therefore reducing the size of the adjustable gap 27. This also reduces the width of the end of the channel as defined by the distance between the deflector surface 9 and the chamfered surface 15.

It, will be noted that the deflector 7 is generally frusto-conical or cone-shaped. The chamfered surface 15 provides a way of smoothing the flow of fluid at the downstream end of channel 23, and as a consequence creates a more laminar fluid flow.

Providing an adjustable gap between the deflector surface 9 and the chamfered surface 15 provides water flow having different profiles, such as a water wall for heat suppression near a flare, as mentioned above. For example, where the gap between the chamfered surface 15 and the deflector surface 9 is small, the flow of water from the nozzle will be disrupted and this will create a non-uniform flow to produce a more diffuse wall of water. Where this distance is larger the flow will be more laminar and the wall of water will be less diffuse.

Figure 2:
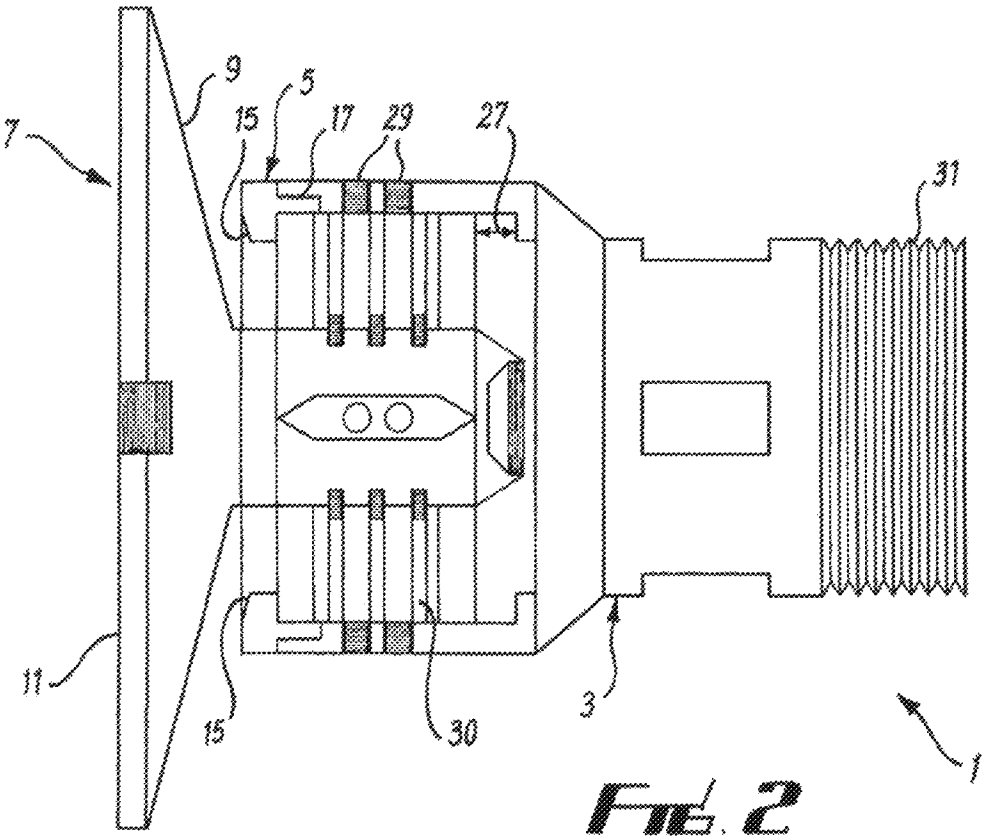
FIG. 2 is a further, partial cross-sectional view of the nozzle of FIG. 1.

The chamfered surface 15 forms part of a coupling ring which is attached to the nozzle body 3. The upstream end of the nozzle body 3 is provided with a nozzle coupler 31, for coupling the nozzle 1 to a hose or pipework. The nozzle 1 is dimensioned for coupling to a 6" (approximately 152 mm) diameter hose or pipe, although it will be understood that the nozzle 1 may be provided for a hose or pipe of any suitable diameter. In this example, the coupler 31 is a screw thread. As the water has been filtered upstream, the gap between surfaces 9 and 15 will provide a flow path that is not restricted by the presence of large particulates. Accordingly, this will not block or inhibit the performance of the nozzle. FIG. 2 provides a further, partial cross-sectional view of the present invention and shows the outer surface of the central beam 10 and the fins 30. The features of this drawing are identical to the features shown in FIG. 1.

Figure 3:
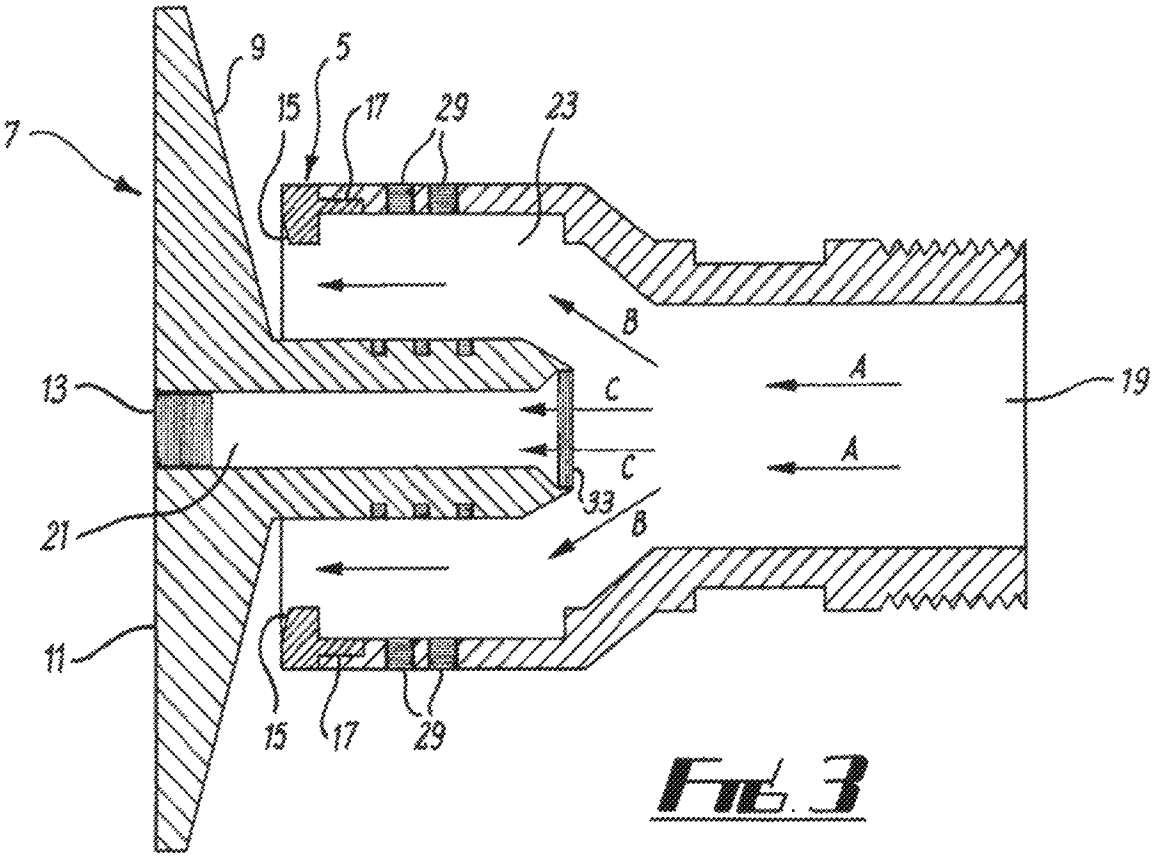
FIG. 3 is another sectional view of the nozzle of FIG. 1 in which the fluid flow paths are shown.

FIG. 3 shows the water flow path through the nozzle.

The water flows through the main channel 19 at the upstream end of the nozzle in direction A. The flow is then split into two portions which flow through the central channel 21 in direction C and through the outer channel 23 in direction B. A filter (not shown) is attached to the filter coupler 33. This prevents particulates from entering the central channel and directs them out through the outer annular channel 23. This is desirable because the purpose of the central channel is to provide a fine mist of water by using a fine nozzle (not shown). The use of a filter prevents particulates from entering the fine nozzle, and thereby blocking it.

As the water flows through the outer channel 23 in direction B, the water is deflected from surface 9 outwards in a pre-determined direction. This direction is determined by the angle of the deflection surface 9 with respect to the direction of bulk flow through the channel 23. In this example, the surface 9 is at an angle of approximately 105° with respect to the central beam. Clearly, therefore, the deflector surface 9 is angled away from the direction of flow B.

Advantageously, it has been found that the use of a deflector surface in this configuration means that the general bulk flow B loses energy only when it is deflected from the surface 9. Therefore, it is possible to produce a more efficient nozzle that requires a lower water pressure to produce a wall of water that extends a predetermined distance from the nozzle than would be possible with the prior art nozzles. In addition, it is possible to produce walls of water that extend further with the same pressure than in the prior art.

It should be noted that in the prior art the exiting water impinges on a first surface, and is thrown backwards, onto a second directing surface for directing the water out from the nozzle. This causes the water to lose energy and therefore causes a reduction in overall pressure.

In addition, the present invention may also be provided with means for altering the width of the gap between the chamfered surface 15 and the deflector surface 9. In order to alter this distance, a spacer ring (not shown) is introduced into the nozzle body so as to reduce the width of gap 27. A number of rings of different width can be used to produce different gap sizes.

FIGS. 4*a*, 4*b* and 4*c* show the components from which an embodiment of the present invention can be made. FIG. 4*a* shows the deflector means 7, FIG. 4*b* shows the coupling ring 5 and FIG. 4*c* shows the nozzle body 3. It is convenient for the nozzle of the present invention to be constructed in three parts in this manner as it allows easy cleaning and maintenance of the nozzle.

FIG. 5 shows a second embodiment of the present invention in which sensors 112 are embedded into the front surface 111 of a nozzle 101. FIG. 1 shows sensors 112 disposed in the nozzle body 3. The sensors can be hard-wired and/or wirelessly and/or acoustically connected through the central channel 121 to a position upstream where data from the sensors can be analyzed. The sensors can be temperature sensor, gas composition sensors or any other desired sensor.

In the examples of FIGS. 1-4 and 5, the fins 30 may be shaped to affect the flow of water through the outer channel 23.

Turning now to FIG. 6, there is shown a longitudinal cross-sectional view of a nozzle in accordance with a third embodiment of the present invention, the nozzle indicated generally by reference numeral 201. Like components of the nozzle 201 with the nozzle 1 of FIGS. 1-4*c* share the same reference numerals incremented by 200.

The nozzle 201 is dimensioned for coupling to a hose or pipe of a diameter in the range of 1.5"-2" (approximately 38 mm-51 mm), although it will again be understood that the nozzle 201 may be provided on a hose or pipe of any suitable diameter, and thus dimensioned accordingly.

The nozzle 201 similar to the nozzle 1 of FIGS. 1-4*c*, except that the nozzle 201 comprises two main components, a nozzle body 203 and a fluid deflector 207 which is coupled to the nozzle body 203. As will be described below, the deflector 207 is secured to the nozzle body 203 by a retaining member in the form of a nut 35.

The nozzle 201 is shown in more detail in the exploded perspective view of FIG. 7. Also, the deflector 207 is shown separately from the body 203 in the end and sectional views of FIGS. 8 and 9, and the body 203 is shown with the deflector 207 removed in the end and sectional views of FIGS. 10 and 11.

Only the main differences between the nozzle 203 and the nozzle 1 of FIGS. 1-4*c* will be described herein in detail.

The body 203 includes a central beam or a shaft 210 which is located by fins 230 that are formed integrally with the body 203. The beam 210 is threaded at 37 and the deflector 207 includes a hub 39 which is internally threaded for engaging the beam threads 37. In this fashion, the deflector 207 may be coupled to the body 203 and the gap between the deflector surface 9 and a chamfered surface 215 of the body 203 may be adjusted by rotating the deflector 207, causing the deflector to advance or retract along the beam 210 relative to a main part of the body 203. The deflector 207 is locked in position by a retaining member in the form of a threaded nut 35 which engages the beam threads 37 and abuts the deflector 207. If required; however, spacer rings (not shown) may be provided between a shoulder 41 of the body 203 and the deflector 207.

In a variation, the deflector 207 may include a smooth hub 39 and may be clamped in position between the shoulder 41 of the body 203 and the nut 35. Spacer rings may be located between the shoulder 41 and the deflector 207 to increase the spacing between the deflector surface 209 and the chamfered surface 215 on the body 203.

In a similar fashion to the nozzle 1, the nozzle 201 defines a central flow channel 221 whilst the body 203 defines an outer flow channel 223. In use, fluid flow is split between the inner and outer channels 221, 223 and a further nozzle may be provided coupled to a coupler 213 on the beam 210.

The nozzle 201 additionally includes a self-cleaning mechanism (not shown) for adjusting the channel width at the downstream end, that is the space or gap between the deflector surface 209 and the chamfered surface 215 of the body 203. The mechanism is typically hydraulic, electrical, electro-mechanical or mechanical and includes an actuator M (shown schematically) for controlling adjustment of the channel width. For example, the mechanism may comprise a motor for adjusting a position of the deflector 207 relative to the body 203. This may be achieved by rotating the deflector 207 to advance or retract the deflector along the beam 210 either by direct rotation of the deflector 207 relative to the beam 210, or the beam 210 may be provided as a separate component coupled to or integral with the deflector 207, and may be rotatable relative to the body 203.

The self-cleaning mechanism may be actuated to increase the channel width between the deflector surface 209 and the chamfered surface 215 of the body 203 in response to the detection of the presence of trapped debris, such as particulate matter in the nozzle 203. Such debris may cause a reduction in the flow rate of fluid through the nozzle and/or an increase in fluid pressure, which may be detected by appropriate sensors. On detection of such a situation, the self-cleaning mechanism may automatically activate the actuator to adjust the position of the deflector 207, increasing the channel width and allowing clearance of the blockage.

The embodiments of the present invention described herein show a nozzle designed for manufacture using a lathe (FIGS. 1 to 5) and by casting (FIGS. 6 to 11). Details of the component design may change where other manufacturing techniques are used to, make the nozzle. Examples of alternative manufacturing techniques are lost wax processing or a combination of techniques.

In addition, the nozzle may be made in modular form or as a single component.

It is also envisaged that the present invention could be used for escape route protection, well control and where blowouts occur.

Improvements and modifications may be incorporated herein without, deviating from the scope of the invention.

The invention claimed is:

1. A nozzle for a hose or fixed pipework installation, the nozzle adapted for forming a wall of fluid adjacent to a flare in a hydrocarbon well test operation and comprising:

a body defining a channel therethrough, the body further defining a central beam or projection which extends into the channel;

a fluid deflector attached to the central beam or projection, the fluid deflector having a deflecting surface;

wherein the fluid deflector is arranged at or near a downstream end of the channel such that the deflecting surface and the body together define a circumferentially continuous outlet, the downstream end of the channel comprises a chamfered surface oriented substantially parallel to the deflecting surface, and the deflecting surface extends beyond an outer width of the body; and a spacer ring disposed in a gap or space between the fluid deflector and a shoulder of the body to alter the position of the fluid deflector relative to the downstream end of the channel, thereby varying the width of the outlet.

2. A nozzle as claimed in claim 1 wherein at least part of the outlet is defined between the deflecting surface and an outlet surface of the body.

3. A nozzle as claimed in claim 1 wherein the deflecting surface is disposed at an obtuse angle relative to a longitudinal axis of the body.

4. A nozzle as claimed in claim 3 wherein the obtuse angle is approximately 105 degrees.

5. A nozzle as claimed in claim 1 wherein the channel comprises a central portion extending through the central beam or projection of the fluid deflector.

6. A nozzle as claimed in claim 5 wherein the nozzle further comprises a filter coupling to couple a filter to an upstream end of the central channel portion.

7. A nozzle as claimed in claim 5 wherein the nozzle further comprises a secondary nozzle coupling to couple a secondary nozzle to a downstream end of the central channel portion.

8. A nozzle as claimed in claim 1 wherein the fluid deflecting surface is frusto-conical, angled away from the direction of fluid flow.

9. A nozzle as claimed in claim 1 wherein a width of the outlet is variable by adjusting a position of the fluid deflector relative to the body.

10. A nozzle as claimed in claim 9 wherein the fluid deflector is movably mounted relative to the body, to enable adjustment of a position of the fluid deflector relative to the body, to facilitate adjustment of the channel opening width of the outlet.

11. A nozzle as claimed in claim 9 wherein the fluid deflector is threadably coupled to the body, such that rotation of the fluid deflector relative to the body advances or retracts the fluid deflector relative to the body, thereby facilitating adjustment of the width of the outlet.

12. A nozzle as claimed in claim 1 comprising one or more temperature sensors.

13. A nozzle as claimed in claim 1 comprising one or more gas sensors.

14. A nozzle as claimed in claim 13 wherein the one or more gas sensors are configured to sense gas composition or pressure.

15. A nozzle as claimed in claim 1 comprising one or more pressure sensors, one or more gas sensors configured to sense gas composition or pressure, or a combination thereof, located in the fluid deflector.

16. A nozzle as claimed in claim 1 comprising one or more temperature sensors, one or more gas sensors configured to sense gas composition or pressure, or a combination thereof, embedded in a front surface of the fluid deflector.

17. A nozzle as claimed in claim 1 comprising one or more pressure sensors for detecting a change in fluid pressure in the channel or one or more fluid flow sensors for detecting a change in fluid flow rate through the channel.

18. A nozzle as claimed in claim 1, wherein the channel comprises a main channel portion upstream of the central beam or projection, and a generally annular channel portion around the central beam or projection, and a maximum diameter of the generally annular channel portion is greater than a maximum diameter of the main channel portion.

19. A kit of parts for a nozzle for forming a water wall adjacent to a flare in a hydrocarbon well-test operation, the kit of parts comprising a body which defines a channel extending therethrough, the body further defining a central beam or projection which extends into the channel, a fluid deflector having a deflecting surface, a coupling to connect the fluid deflector to the body, and a spacer ring to alter the position of the fluid deflector relative to the body, wherein the kit of parts when assembled forms the nozzle wherein:

the fluid deflector is attached to the central beam or projection using the coupling;

the fluid deflector is arranged at or near a downstream end of the channel and the deflecting surface and the body together define a circumferentially continuous outlet;

the downstream end of the channel comprises a chamfered surface oriented substantially parallel to the deflecting surface;

the deflecting surface extends beyond an outer width of the body; and the spacer ring is disposed in a space or gap between the fluid deflector and a shoulder of the body, thereby varying the width of the outlet.

20. A nozzle for a hose or fixed pipework installation, the nozzle adapted for forming a wall of fluid adjacent to a flare in a hydrocarbon well test operation and comprising:

a body defining a channel extending therethrough, the body further defining a central beam or projection which extends into the channel such that the channel comprises a main channel portion upstream of the central beam or projection and a generally annular channel portion around the central beam or projection at a downstream end of the channel;

a fluid deflector having a deflecting surface wherein the fluid deflector is attached to the central beam or projection, the fluid deflector is arranged at or near a downstream end of the channel such that the deflecting surface and the body together define a circumferentially continuous outlet, the deflecting surface extends beyond an outer width of the body, and wherein a maximum diameter of the generally annular channel portion is greater than a maximum diameter of the main channel portion; and a spacer ring disposed in a gap or space between the fluid deflector and a shoulder of the body to alter the position of the fluid deflector relative to the downstream end of the channel, thereby varying the width of the outlet.

21. A nozzle as claimed in claim 20, wherein the downstream end of the channel comprises a chamfered surface oriented substantially parallel to the deflecting surface.

22. A nozzle as claimed in claim 20, wherein the deflecting surface is circumferentially uniform.

23. A nozzle for a hose or fixed pipework installation, the nozzle adapted for forming a wall of fluid adjacent to a flare in a hydrocarbon well test operation and comprising:

a body defining a channel extending therethrough;

a fluid deflector having a deflecting surface and a central beam or projection which extends from the deflecting surface into the channel, wherein the fluid deflector is arranged at or near a downstream end of the channel such that the deflecting surface and the body together define a circumferentially continuous outlet, the central beam or projection is attached to the body upstream from the circumferentially continuous outlet, the downstream end of the channel comprises a chamfered surface oriented substantially parallel to the deflecting surface, and wherein the deflecting surface extends beyond an outer width of the body;

fins extending between the central beam or projection of the fluid deflector and the body, wherein the fins secure the fluid deflector to the body;

a coupling ring attached to the body to secure the fins in place; and a fixed ring or a spacer ring located between the coupling ring and the fins to position the deflector within the body.

24. A nozzle as claimed in claim 23, wherein the channel comprises a main channel portion upstream of the central beam or projection and a generally annular channel portion around the central beam or projection, and a maximum diameter of the generally annular channel portion is greater than a maximum diameter of the main channel portion.

25. A nozzle for a hose or fixed pipework installation, the nozzle adapted for forming a wall of fluid adjacent to a flare in a hydrocarbon well test operation and comprising:

a body defining a channel extending therethrough;

a fluid deflector having a deflecting surface and a central beam or projection which extends from the deflecting surface into the channel so as to define a main channel portion upstream of the central beam or projection and a generally annular channel portion around the central beam or projection at a downstream end of the channel;

wherein the fluid deflector is arranged at or near a downstream end of the channel such that the deflecting surface and the body together define a circumferentially continuous outlet, the central beam or projection is attached by fins to the body upstream from the circumferentially continuous outlet, the deflecting surface extends beyond an outer width of the body, and a maximum diameter of the generally annular channel portion is greater than a maximum diameter of the main channel portion; and a fixed ring or spacer ring disposed in a gap or space, between the fins and a coupling ring attached to the body, to alter the position of the fluid deflector relative to the downstream end of the channel, thereby varying the width of the outlet.

26. A nozzle as claimed in claim 25, wherein the downstream end of the channel comprises a chamfered surface oriented substantially parallel to the deflecting surface.

27. A nozzle as claimed in claim 25, wherein the deflecting surface is circumferentially uniform.

* * * * *